United States Patent [19]

Cunningham et al.

[11] Patent Number: 4,915,166

[45] Date of Patent: Apr. 10, 1990

[54] TITANIUM HEAT EXCHANGE TUBES

[75] Inventors: James L. Cunningham; Bonnie J. Campbell, both of Decatur, Ala.

[73] Assignee: Wolverine Tube, Inc., Decatur, Ala.

[21] Appl. No.: 792,959

[22] Filed: Oct. 30, 1985

Related U.S. Application Data

[63] Continuation of Ser. No. 520,265, Aug. 4, 1983, abandoned.

[51] Int. Cl.[4] ..... F28F 1/36; F28F 21/08

[52] U.S. Cl. ..... 165/184; 72/96; 72/98; 72/100

[58] Field of Search ..... 165/184; 72/100, 96, 72/98, 69

[56] References Cited

U.S. PATENT DOCUMENTS

| | | | |
|---|---|---|---|
| 1,865,575 | 7/1932 | Locke | 165/184 |
| 2,508,518 | 5/1950 | Hill | 72/100 |
| 2,761,336 | 9/1956 | Green et al. | 72/96 |
| 2,868,046 | 1/1959 | Greene | 72/100 |
| 3,174,319 | 3/1965 | Koyama et al. | 72/96 |
| 3,379,042 | 4/1968 | Brown, Sr. | 72/96 |
| 3,383,893 | 5/1968 | Counts | 72/98 |
| 3,559,437 | 2/1971 | Withers, Jr. | 72/96 |
| 3,600,922 | 8/1971 | Schmeling | 72/98 |
| 3,768,291 | 10/1973 | Rieger | 72/98 |
| 3,795,125 | 3/1974 | Laing et al. | 82/69 |
| 4,366,859 | 1/1983 | Keyes | 165/184 |

FOREIGN PATENT DOCUMENTS

| | | | |
|---|---|---|---|
| 2109913 | 6/1983 | United Kingdom | 164/184 |

*Primary Examiner*—John Ford

*Attorney, Agent, or Firm*—Barry L. Clark

[57] ABSTRACT

Improved method and apparatus for making finned tubing from difficult to work materials such as titanium and stainless steel uses spaced sets of finning discs on a plurality of arbors to form a tube against a mandrel having different diameters under each set of discs. By forming the tube fin tips to their final O.D. in a first disc set and by deepening their roots to bring the fins to their final height in a second disc set, tubes with higher fin counts and/or higher fin heights can be achieved than were formerly possible. The process of separately cold working the tips and roots also permits tubes to be made which are dimensionally identical to prior art tubes but with higher quality and productivity since tube stresses are greatly reduced. An improved titanium tube is also disclosed which has at leasts 26 fins per inch, a fin height of at least 0.034" and an outside to inside surface area ratrio of at least 3.0.

5 Claims, 2 Drawing Sheets

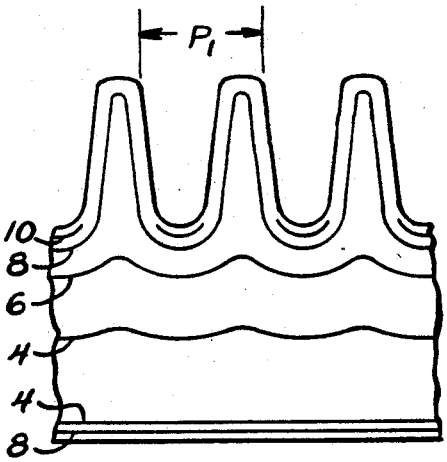
FIG. 2
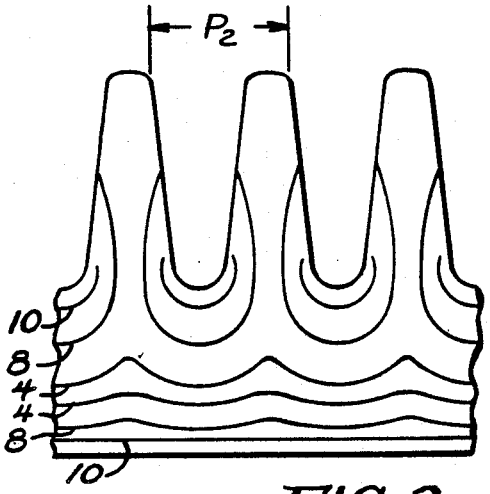
FIG. 3
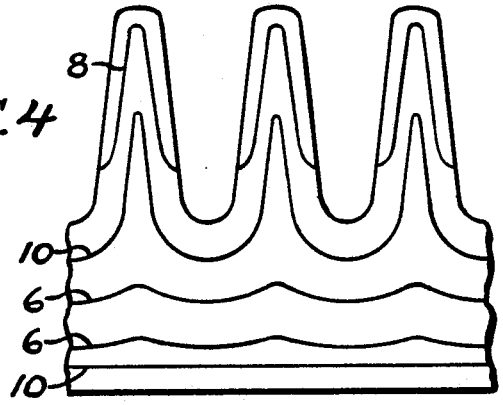
FIG. 4
FIG. 5a
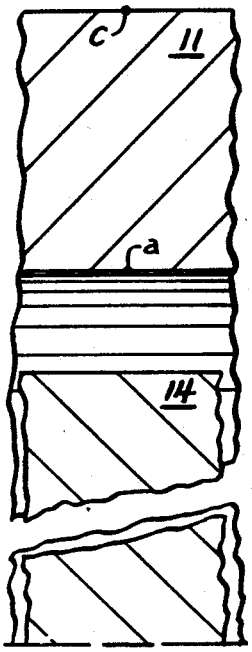
FIG. 5b
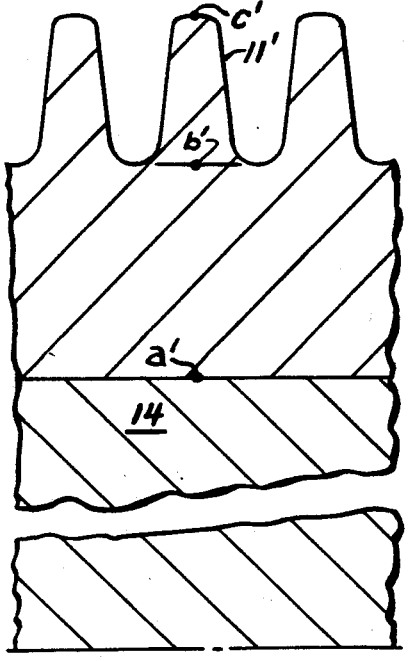
FIG. 5c
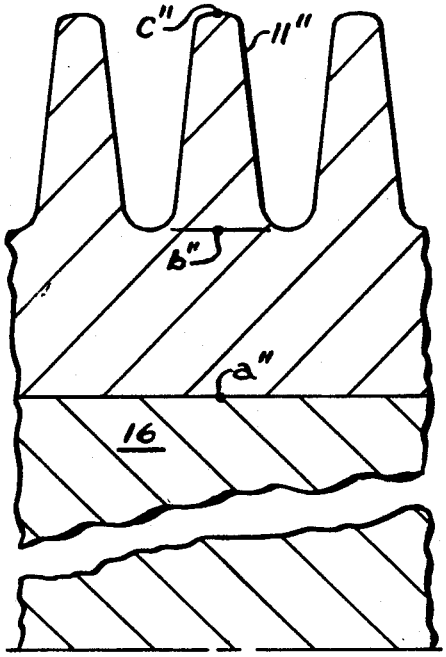

TITANIUM HEAT EXCHANGE TUBES

This is a continuation of application Ser. No. 520,265, filed Aug. 4, 1983, now abandoned.

BACKGROUND OF THE INVENTION

The invention relates to heat exchanger tubes and particularly to such tubes which are provided with fins. Finned tubes are used extensively in applications such as refrigeration and processing where it is desirable to maximize surface contact area and minimize tube length, weight and volume.

Materials for heat exchanger tubing vary widely depending upon their characteristics such as cost, corrosion resistance and fabricability. In recent years, titanium has been receiving increased usage due to its excellent corrosion resistance in a variety of environments as well as due to its increased availability and the decreased cost of welded tube relative to the extruded seamless tube formerly used. However, fabrication of finned tubing out of titanium is severely complicated by some differences in the mechanical and physical properties of titanium as compared with other materials, notably copper, aluminum and various nickel alloys. Most significant of these properties is the rate of work hardening. When metal is worked at a temperature below its crystallization temperature, its strength is increased while its ductility or ability to be deformed without cracking is decreased. Continued deformation in this region of temperature can continue until a point is reached where fracture occurs. This fracture may be complete separation of the part into two or more pieces. However, such total separation is usually preceded, except in the most brittle of metals, by localized cracking. In a normal production operation, it is desirable to establish conditions such that any form of cracking rarely occurs. Thus, to take into account the many variables involved in a finning operation, such as tool wear and variations in dimensions, material and temperature, a total deformation significantly below the values determined by destructive tests is chosen.

There are several alternative methods of improving the workability of material so as to increase its ability to accommodate more deformation without failure. These include increasing the working temperature of the material and heat-treating the material between successive stages of deformation. As a general rule, the strength of a material decreases, and the ductility increases, with increasing temperature. However, with most metals and alloys, a point is reached, as temperatures increase, at which the material no longer work hardens. As rapidly as the material is deformed, the metal relieves itself of the effect of the strain and a new strainfree, non-work-hardened structure is generated.

Heat-treatment is a broad term which covers any heating operation performed on a metal and its effects of course vary with each metal or alloy. Recrystallization is the heat-treatment of most significance in the present context. During recrystallization, old grains, which have accommodated deformation and, consequently, have become strain-hardened, are replaced progressively through the formation of new grains which are free of the effects of the previous strain and are thus ready to accommodate as much strain as were the original grains before any deformation occurred. Another heattreatment, known as recovery, involves the reduction or removal of work-hardening (strain-hardening) without apparent, or at least major, motion of grain boundaries, that is, without major recrystallization. Recovery will usually result in the ability of a metal to accept some more deformation prior to fracture, but not as much as would have been accommodated had the material been fully recrystallized. While high temperature working and heat treatments do offer some technical advantages, they are usually accompanied by increased costs due to increased equipment, labor, facility and other associated components of manufacturing.

In the manufacture of finned tubing, the fins usually extend in a helix along the length of the tube and are produced through use of forming tools which deform the tube and force a portion of the metal radially outwardly to form fins while at the same time the I.D. of the tube is forced radially downward. The tools produce a continuous fin which normally has an outside diameter equal to or slightly less than the starting outside diameter of the tube. Between each fin is a groove which is formed by the tooling and which defines the root diameter (R.D.) of the fin. The R.D. is smaller than the original diameter of the tube. In the conventional fin-forming operation, the forming is done using one or more sets of discs which force the tube against an internal mandrel pin which which has a work surface with a constant diameter which is less than the I.D. of the starting tube. During the deformation, the amount of work-hardening present in each portion of the work piece will vary widely. For example, there will be areas of high work-hardening near the outer diameter of the fin, with relatively low work-hardening effect in the tube wall under the fin. If one then assumes that the areas of highest work-hardening which are produced near the outer diameter of the fin are the maximum achievable prior to failure, one may conclude that this configuration limits the fin dimensions which are possible without use of hot working, heat treatment, and/or metal removal procedures.

Historically, in the development of finned tubing, fin counts and fin heights started with lower fin densities, such as 16 fins per inch (f.p.i.) and higher fin heights, such as 0.050", especially in the easy to fin materials such as copper, copper alloys and low carbon steels. Most probably, this situation prevailed more because of the ability of manufacturers to fabricate suitable durable tools than because of the ability or inability of the material to withstand the work applied. At the present time, advances in tooling and in finning technology have allowed manufacture of products with fin densities of double or more the aforesaid figure of 16 f.p.i. In the case of the easier to fin alloys, the prior fin heights have been held and even advanced to 0.060" or so. Obviously, the general goal of development work in connection with fin tubes is to maximize heat transfer while minimizing tube length and cost. Where higher fin counts and higher fin heights can be achieved, it is obvious that the ratio Ao/Ai of the outside area to the inside area will be increased, thus increasing heat transfer and permitting less length of tubing to be used than is the case with a lower Ao/Ai ratio.

In the situation of the difficult to fin refractory alloys such as titanium and stainless steel, it had been felt necessary, in the past, to have fin walls under the fin, for titanium, of about 0.042" to produce fin densities of about 19 f.p.i. and fin heights of 0.035". Similar figures for stainless steel were 0.065" wall, 16 f.p.i. and 0.050" fin heights. Later proposals were made to increase the fin density, such as to 26 f.p.i., for titanium, while decreasing the fin height to about 0.025" and reducing the wall thickness under the fin to about the same value. The last noted parameters increased the ratio of the outside tube surface area to the inside area as compared to the parameters formerly used. The aforementioned later proposals are at least generally embodied in U.S. Pat. No. 4,366,859 issued to John M. Keyes. The Keyes patent emphasizes that fin heights should not exceed 0.033" for titanium, or 0.045" for stainless steel, an argues that "fin splits" will occur if these heights are exceeded. The Keyes patent shows the tubing as being finned on a mandrel having a single diameter work surface against which the tube is forced by one or more arbors carrying single sets of discs.

Another patent related to the finning of difficult to fin materials is Laing et al, U.S. Pat. No. 3,795,125 which discloses a method of forming fins with a height of at least 0.100" on stainless steel tubes. The fins are formed in two completely separate finning operations through separate sets of discs with differing contours. The second finning operation produces both a substantial increase in the fin O.D. and a decrease in its R.D. but cannot be performed without an intermediate annealing operation. The technique is time-consuming and costly. Also, it is not very practical when making the vast majority of tubes which require intermediate unfinned lands and plain ends due to the fact that there would be a non-predictable varying amount of stretch of the tube between the separate finning passes. This situation would make it practically impossible to produce lands positioned within currently accepted dimensional specifications.

Two patents relating to the finning of easy to fin material such as copper are U.S. Pat. No. 2,868,046 to Greene and U.S. Pat. No. 3,383,893 to Counts. Each shows a disc arbor with spaced sets of discs with the discs all being of different contours.

SUMMARY OF THE INVENTION

It is among the objects of the present invention to provide a heat transfer tube of a difficult to form material such as titanium or its alloys which will provide an outside to inside surface area ratio which is at least 3.0 and higher than those previously available. Another object is to provide such difficult to form tubes with combinations of fin densities and fin heights which are similar to those used for easy to fin materials and which exceed those previously thought possible with difficult to form materials. A still further object is to provide an apparatus and method for finning a tube made from difficult to form material to provide combinations of previously unattainable fin heights and/or fin counts in a single pass and in such a manner that the tube will not be overstressed. Yet another object is to form tubes in a single finning pass which have combinations of fin heights and fin counts no greater than those previously obtainable but in a manner that reduces stresses in the work and tools and improves quality and productivity.

The foregoing and other objects and advantages are attained by the improved heat transfer tube of the present invention and by the apparatus and method which has been disclosed for making it.

The improved tubing has, in the case of titanium or alloys thereof containing at least 50% titanium, at least 26 f.p.i., a fin height of at least 0.034" and a ratio between its outer and dinner surface areas of at least 3.0. By way of comparison to a particular, hereinafter defined, part number of a tube, "305028," made in accordance with the teaching of the aforementioned Keyes U.S. Pat. No. 4,366,859, a tube made in accordance with the present invention was calculated to provide an improvement of about 28% in the ratio Ao/Ai of the areas of the outside tube surface to the inside tube surface. As is well known in the tube art, part number "305028" means that the tube has 30 fins per inch, a root diameter of 5 one-eighths of an inch and an average wall thickness under the fin of 0.028". According to the Keyes patent, the fin height can be a maximum of 0.032", giving an Ao/Ai ratio of 3.0. However, in one example of a tube made in accordance with the present invention, a fin height of 0.047" was achieved, providing an Ao/Ai ratio of 4.0. When the rather unconventional ratio of the fin surface area after finning to the outside surface area prior to finning is considered, the improvement in the value of the ratio as compared to Keyes can be calculated to be 32% (3.2 vs. 2.4). The latter ratio is the one discussed in the Keyes patent as representing a 26% improvement over the prior art. Obviously, the area ratio will vary, depending upon the particular part numbers being produced.

To achieve the previously noted improvement in tube performance, we prefer to make the tube in either 1, 2 or 3 starts, but not limited to either, by at least two disc arbors, and preferably three or four, which each have at least two sets of discs separated by a relatively wide space. We also prefer to use a mandrel having a surface characterized in that the diameter of the mandrel pin is different under each of the spaced sets of discs. This could be achieved by stepping or by a tapered surface. Finally, we prefer to grind all of the discs to the same tip contour so they differ only in their diameters. The latter technique greatly minimizes tooling costs and also causes the fins to be formed in a much different manner than would be the case with the discs disclosed in the various aforementioned patents. In practicing the improved method, the tube is first finned to obtain normal fin heights with the first tooling set in cooperation with the larger diameter portion of the mandrel. It is then additionally finned in the same pass, and without an intermediate annealing, by a second tooling set in cooperation with a smaller diameter portion of the mandrel. The first tooling set determines, or at least substantially determines, the final O.D. of the fin. The second tooling set does not change or at least does not appreciably change the O.D. but it does substantially reduce the R.D. thus producing substantially higher fin heights than is normally possible without excessive working of the material or without an intermediate heat treatment. The tooling holders or disc arbors which support the tooling discs are set at angles relative to the tube in the usual manner so as to advance the work. They are also preferably geared together for rotation relative to each other and the tube so that when the tube has made a complete rotation, it will have advanced through 1, 2, 3 or more pitches. It will be appreciated that the foregoing apparatus and method will not move the fin tips up any more than is normal for low fin height finned tubes, as discussed in the Keyes patent, and will thus not overly work the tips. It does, however, move the R.D. down in the second tooling set after the fin has been moved up in the first set, and thus permits a tube having the same fin count as in Keyes to be provided with a substantially higher fin height without developing undesirable fin stresses or increasing the wear and tear on the tooling. However, it should be recognized, that, the 0.033" maximum upper limit on fin heights discussed by Keyes is one which pushes the material and tooling to a limit. Thus, one could expect that the quality of the tubes produced and the productivity of the tooling would be somewhat compromised as compared to manufacturing a tube having a much lower fin height.

The invention also relates to a novel method of achieving a high degree of overall working of the tube material in order to achieve a fin configuration which would either not be otherwise obtainable by a single working operation or would possibly compromise tube quality and/or productivity. Additionally, the added expenses associated with either high temperature working and/or one or more recrystallization steps are avoided.

The invention provides a very substantial improvement in either the ratio of the outer to inner surface areas Ao/Ai or in tube quality and/or productivity by taking advantage of the fact that the tube deformation during finning provides widely varying amounts of work hardening in different regions of the workpiece. As discussed in the Keyes patent, work hardening at the fin tip would appear to limit the overall fin height. However, we have determined that the amount of work hardening present in each portion of the workpiece will vary widely for reasons discussed hereinafter in detail in connection with the accompanying drawings. The drawings will indicate that a single finning pass forming the maximum fin height proposed by Keyes will produce areas of high work hardening near the outer diameter of the fin, but will produce relatively low work hardening effect in the tube wall under the fin. Our invention takes advantage of the large volume of material in the tube which has much less than the critical amount of work hardening in it. This is done in or process by utilizing the amount of deformation available without exceeding the critical strain limit at any location.

In our process, a second fin-forming operation is performed subsequent to the first one in which both the root diameter of the groove and the inside diameter of the tube are simultaneously reduced. This reduction is achieved through use of a second mandrel section whose diameter is smaller than the diameter of the first mandrel section used in the first finning operation to initially form the fin to a height and outer diameter within the limits proposed by Keyes. As the discs on the tooling arbors press against the groove from the outside of the tube, the pressure causes the tube I.D. to be reduced in diameter down to approximately the same diameter as the mandrel. There is no significant change in the fin O.D. during this step. Thus, the decrease in the groove diameter and the inside tube diameter lead to more surface area in the fin, thereby increasing the overall efficiency of the tube.

Although the process described hereinteaches that substantial increases in tube surface areas and/or in tube quality can be made in a single finning pass using two sets of finning discs and two different diameter mandrel sections and without-heat treatment steps, it would be within the scope of the present invention to use three or more sets of finning discs in combination with three or more different diameter mandrel sections to achieve a final desired tube shape. Furthermore, the height of fin achieved by the various sets of discs can be varied to optimize and or equalize the overall work hardening for a particularly desired final result of work patterns within the workpiece. Also, a lighter wall under the fin could be achieved than is possible with conventional techniques since less unit pressure needs to be applied.

The preceding description of the invention makes particular mention of titanium and stainless steel as examples of difficult to form materials. However, we do not intend to limit the invention to these materials since its advantages would also be applicable to other difficult to form materials. For example, copper, although relatively easy to form to fin heights higher than previously thought possible in titanium or stainless steel.

BRIEF DESCRIPTION OF THE DRAWINGS

FIG. 2 is an enlarged view of a tube cross-section which schematically indicates the work hardening which might be present in the tube at region "X" in FIG. 1 by means of lines which connect and define points of equal deformation and, as a first approximation, points of equal strain hardening;

FIG. 3 is a view similar to FIG. 2 but schematically showing the nature of the deformation which would take place in the tube cross-section at region "Y" in FIG. 1;

FIG. 4 is a view representing a summation of the strain hardening effects from both the first finning operation (FIG. 2) and the second finning operation (FIG. 3) as they would be embodied in the finished tube at region "Z" of FIG. 1; and FIGS. **5*a*–5*c* are enlarged, partially broken away, views showing the relationship between the tube cross-sectional and mandrel at regions "W", "X" and "Y" in FIG. 1**.

DETAILED DESCRIPTION OF THE DRAWINGS

Figure 1:
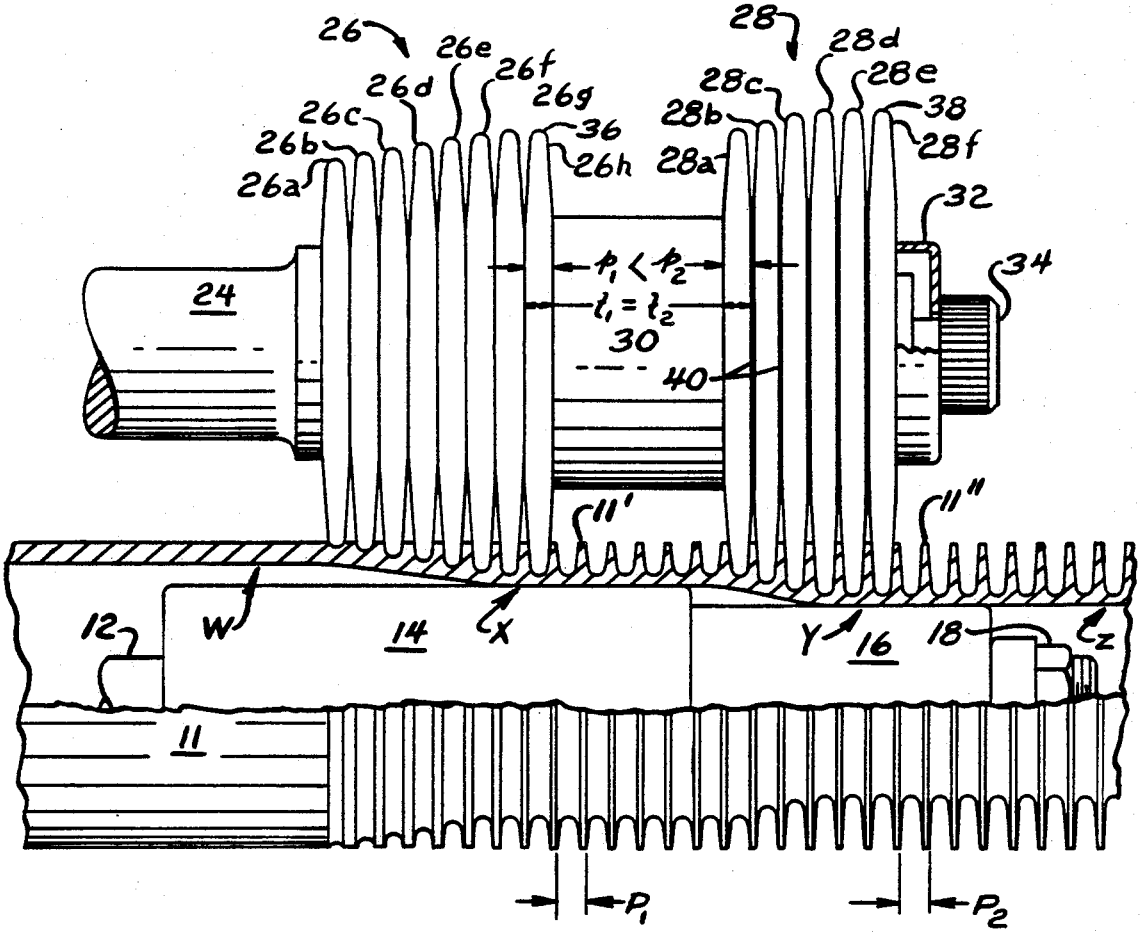
FIG. 1 is a side view, partially in section, showing the relationship of the spaced sets of finning discs and the varying diameter mandrel sections to the tube as the tube is being formed.

Referring to FIG. 1, a tube indicated generally at 11 is shown in working relationship with respect to a mandrel holding rod 12 having a first larger diameter mandrel section 14 and a second smaller diameter mandrel section 16 held thereon by a fastening member 18. In order to provide relatively uniform finning pressure to the tube during forming, a plurality of finning arbors 24 are located circumferentially around the tube on skewed axes in the usual fashion. The arbors are each provided with spaced sets 26 and 28 of finning discs which are separated by a spacer member 30 and retained on the arbor by fastener means such as a cup washer 32 and socket head screw 34. Preferably, the individual fin discs **26*a*–26*h* and 28*a*–28*f* all have their thicknesses $t_1$ and $t_2$ equal to each other and they also all have their outer tip side and end contours 36 and 38 equal to each other. Thus, the 14 different discs shown differ only in that their outer diameters vary, thereby greatly facilitating their manufacture. Although they are not visible in the small scale of FIG. 1, the disc 28*a*–28*f* are each separated by a thin shim or spacer member 40 which, together with the disc thickness $t_2$, would cause the pitch, $p_2$, of the second set of discs 28 to be slightly greater than the pitch, $p_1$, of the first set of discs 26. This situation results in causing the high fins 11" produced in region "Y" of the tube by the second set of discs 28 to have a slightly greater pitch than the less high fins 11' produced in region "X" by the first set of fins 26. The fins 11' produced by disc set 26 are lengthened considerably in a vertical direction as they pass through the disc set 28. However, the thickness of their tips and their outer diameter remains substantially constant since the additional space between the fins in disc set 28 which is provided by the shims 40 permits the fin tips to move further into the V-shaped slots between the discs so that the roots of the fins will have their root diameters decreased from the dimension provided by disc 26***h* to the dimension provided by disc 28*f*. The difference in pitch $p_1$ and $p_2$ between the disc sets 26, 28 and the stretch introduced in the tube 11 as it is worked causes the tube pitch to vary from a dimension of $P_1$ when it leaves the first disc set 26 to a larger dimension $P_2$ when it leaves the second disc set 28. FIGS. 2 and 3 illustrate the fact that the pitch distance $P_1$ of the fins at region "X" of FIG. 1 is less than that at region "Y". They also schematically represent the work hardening present in the tube 11 as it is being formed in regions "X" and "Y", respectively, in FIG. 1. The lines 2, 4, 6, 8 and 10 which have been drawn are intended to connect and define points of equal deformation, and as a first approximation, points of equal strain hardening, with higher numbers representing higher stress. In FIG. 2, it can be seen that the areas 10 of high work hardening are near the outer diameter of the fin. In FIG. 3, it can be seen that the areas 10 of high work hardening are in the area of the tube wall under the fins, and thus do not affect the fin tips. Although small areas 10 of high work hardening are also indicated immediately under the roots in FIG. 2, this area is not as critical with respect to being additionally worked as the fin tips would be.

FIG. 4 represented a summation of the strain hardening effects from both the first finning operation (FIG. 2) and the second finning operation (FIG. 3) and would be representative of the composite strain hardening effects present in the tube at region "Z" in FIG. 1. It can be noted that the amount of working is more uniform than for either of the separate finning operations. Thus, the two-step process takes full advantage of the cold-workability of the starting material without expensive heat treatment processes.

FIGS. 5*a*, 5*b* and 5*c* illustrate the relative thicknesses of the outer wall of the tube 11 and the dimensions of the mandrel and tube at locations "W", "X" and "Y" in FIG. 1. In FIG. 5*a* the tube has a wall thickness of ac before finning. Following the first finning operation with the set of discs 26 (FIG. 1), the wall thickness under the fin is reduced to the dimension a'b' while the fin tip 11' is worked to a height of b'c'. Following the second finning operation with the set of discs 28, the wall thickness under the fin is reduced to the dimension a"b" and the fin height is increased to the dimension b"c". As previously discussed, the mandrel diameter is also reduced from the relatively larger diameter shown at 14 in FIGS. 1 and 5*b* to the relatively smaller diameter shown at 16 in FIGS. 1 and 5*c*.

In an example of a tube made in accordance with the invention, a starting tube having an O.D. of 0.74741 , a wall thickness of 0.054" and an I.D. of 0.640" was finned in a three arbor finning apparatus. The tube was welded titanium Grade 2 which is a tube of essentially pure titanium. Referring to FIGS. 5*a*–5*c*, the first mandrel section 14 had an O.D. of 0.590", while the second mandrel section 16 had an O.D. of 0.580". The first set of discs 26 (FIG. 1) formed the fins 11' (FIG. 5*b*) so that the fin height b'c' had a value of 0.032" and an R.D. of 0.683". The second set of discs 28 (FIG. 1) formed the fins 11" (FIG. 5*c*) so that the fin height b"c" had a value of 0.047" and an R.D. of 0.653". The final I.D. of the tube was 0.597", producing a wall thickness under the fin of 0.028". The tube I.D. is somewhat larger than the O.D. of the mandrel section 16 since the tube has an inherent springback which prevents it from assuming the same dimension as the mandrel. The final fin pitch $P_2$ (FIG. 3) was 30 fins per inch as compared to the $P_1$ value of 32 fins per inch (FIG. 2) produced by the first set of discs 26. The difference in pitch is a result of stretching of the tube and is accommodated in the second set of discs 28 by placing shims 40 (FIG. 1) having a thickness of about 0.002" between each of the discs 28*a*–28*f*.

We claim as our invention:

1. A heat exchange tube made of titanium or an alloy thereof containing at least 50% titanium comprising at least one integral helical fin with a fin density of at least 26 fins per inch of tube, a fin height of at least 0.034" and a surface area ratio between its outer surface and its inner surface which is greater than 3.0, said at least one fin and the tube wall which is under said at least one fin being strain hardened to a greater extent in the tube wall under said at least one fin than in the tip of said at least one fin, said at least one fin being formed in a single pass, without intermediate annealing, by at least two spaced apart sets of finning discs, the strain hardening of the tip of said at least one fin being produced substantially completely by the first of said sets of finning discs and the strain hardening in the tube wall under said at least one fin being produced substantially completely by the last of said sets of finning discs.

2. A heat exchange tube according to claim 1 wherein said tube has 26–60 fins per inch and a fin height in the range of 0.034–0.075".

3. A heat exchange tube according to claim 1 wherein said tube has 26–50 fins per inch and a fin height in the range of 0.034–0.060".

4. A heat exchange tube according to claim 1 wherein said tube has 26–40 fins per inch and a fin height in the range of 0.040–0.050".

5. A heat exchange tube made of titanium or an alloy thereof containing at least 50% titanium comprising at least one integral helical fin with a fin density of at least 26 fins per inch of tube, a fin height of at least 0.034" and a surface area ratio between its outer surface and its inner surface which is greater than 3.0, said tube having a wall thickness under the fins which is no greater than the height of the fins, said at least one fin being characterized in that it is formed in a single pass without intermediate annealing by spaced apart sets of finning discs which sequentially cause the tip portion of said at least one fin to be formed to its final outer diameter and then cause the root to be formed to its final depth.

* * * * *